US006301998B1

(12) United States Patent
Hu

(10) Patent No.: US 6,301,998 B1
(45) **Date of Patent: *Oct. 16, 2001**

(54) RATCHET WHEEL WITH ASYMMETRIC ARCUATE CONCAVE TEETH OR NON-ARCUATE CONCAVE TEETH AND SOCKET WRENCH WITH SUCH RATCHET WHEEL

(76) Inventor: Bobby Hu, 8th Floor, Suite 1, No. 536, Da-Jinn Street, Nan Twen Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/635,485

(22) Filed: Aug. 9, 2000

Related U.S. Application Data

(63) Continuation-in-part of application No. 09/365,738, filed on Aug. 3, 1999.

(51) Int. Cl.[7] ..... B25B 13/46
(52) U.S. Cl. ..... 81/60; 81/63.1
(58) Field of Search ..... 81/60, 62, 63.1

(56) References Cited

U.S. PATENT DOCUMENTS

| | | | | |
|---|---|---|---|---|
| 1,614,039 | | 1/1927 | Mandl . | |
| 2,317,461 | * | 4/1943 | Jackson | 81/60 |
| 2,764,048 | * | 9/1956 | Thompson | 81/60 X |
| 3,577,816 | | 5/1971 | Alexander . | |
| 3,742,788 | | 7/1973 | Priest . | |
| 4,991,468 | * | 2/1991 | Lee | 81/60 |
| 5,533,427 | | 7/1996 | Chow . | |
| 5,636,557 | * | 6/1997 | Ma | 81/60 |
| 6,148,695 | * | 11/2000 | Hu | 81/60 |

FOREIGN PATENT DOCUMENTS 921198 12/1954 (DE) .

* cited by examiner

*Primary Examiner*—Joseph J. Hail, III
*Assistant Examiner*—Anthony Ojini
(74) *Attorney, Agent, or Firm*—Rosenberg, Klein & Lee

(57) ABSTRACT

A ratchet wheel includes an outer periphery. The outer periphery includes a number of arcuate concave teeth each having two sides and an intersection of the two sides. The ratchet wheel includes a center, a line from the center to the intersection dividing an angle between the two sides into two unequal portions, thereby forming asymmetric arcuate concave teeth to provide improved structural strength and improved torque. In another embodiment, the concave teeth are non-arcuate to reduce the formation time for the teeth, thereby reducing the production cost.

20 Claims, 13 Drawing Sheets

Fog.13a
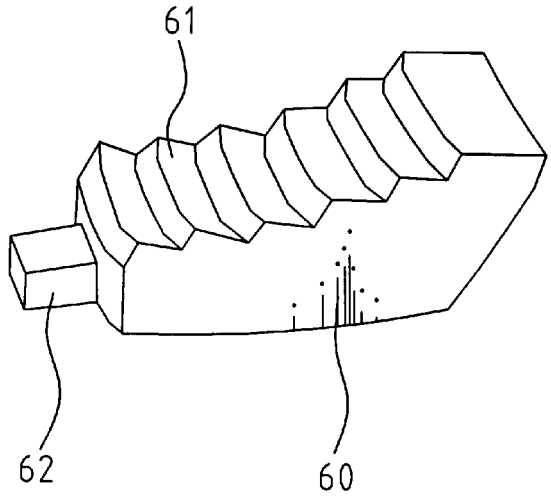
Fig.13b
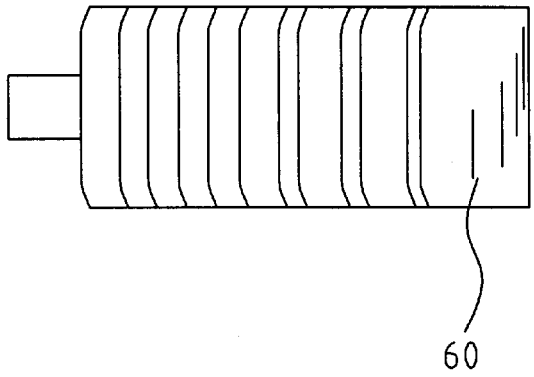
Fig.13c
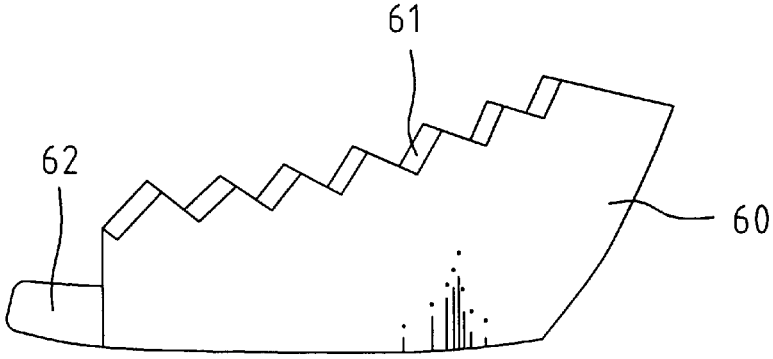

RATCHET WHEEL WITH ASYMMETRIC ARCUATE CONCAVE TEETH OR NON-ARCUATE CONCAVE TEETH AND SOCKET WRENCH WITH SUCH RATCHET WHEEL

CROSS REFERENCE TO RELATED APPLICATION

This is a continuation-in-part application of U.S. patent application Ser. No. 09/365,738 filed on Aug. 3, 1999.

BACKGROUND OF THE INVENTION

1. Field of the Invention

The present invention relates to a ratchet wheel with asymmetric arcuate concave teeth or non-arcuate concave teeth. The present invention also relates to a socket wrench in which the ratchet wheel is mounted. The ratchet wheel with asymmetric arcuate concave teeth provides improved structural strength and improved torque. The ratchet wheel with non-arcuate concave teeth is easy to form and thus reduces the production cost.

2. Description of the Related Art

A wide variety of spanners and wrenches have heretofore been provided. Ring spanners are the best choice for driving fasteners (e.g., nuts, bolt heads, etc) in a limited space that is uneasy to access and difficult to operate all kinds of ratcheting tools. Nevertheless, conventional ring spanners have low driving torque. Ratchet type ring spanners have been proposed to solve this problem. A ratchet wheel is mounted in the box end of a ring spanner for driving fasteners at high torque. It is, however, found that, the structural strength of the ratchet wheel is weak as an outer periphery of the ratchet wheel is processed to form a plurality of arcuate teeth with a considerable depth. U.S. patent application Ser. No. 09/365,738 proposes a ratchet wheel with asymmetric arcuate concave teeth or non-arcuate concave teeth as well as ratchet type ring spanners with such ratchet wheel. The present invention is intended to provide a ratchet wheel that is particularly suitable for socket wrenches.

SUMMARY OF THE INVENTION

It is a primary object of the present invention to provide an improved ratchet wheel that has asymmetric arcuate concave teeth for providing improved structural strength and improved torque.

It is another object of the present invention to provide an improved ratchet wheel that has non-arcuate concave teeth to allow higher production rate, as the non-arcuate concave teeth can be formed by means of roll squeezing method, investment casting. or molding. The non-arcuate concave teeth may be symmetric or asymmetric. The ratchet wheel with non-arcuate concave teeth may bear higher torque during ratcheting (i.e., tightening or loosening a fastener).

The present invention also provides a socket wrench equipped with a ratchet wheel in accordance with the present invention. In an embodiment of the invention, the socket wrench has a head for receiving a ratcheting wheel with asymmetric arcuate concave teeth. In another embodiment of the invention, the socket wrench has a head for receiving a ratcheting wheel with non-arcuate asymmetric concave teeth. In a further embodiment of the invention, the socket wrench has a head for receiving a ratcheting wheel with non-arcuate symmetric concave teeth.

Other objects, advantages, and novel features of the invention will become more apparent from the following detailed description when taken in conjunction with the accompanying drawings.

BRIEF DESCRIPTION OF THE DRAWINGS

FIG. 13*a* is a perspective view of a pawl for cooperating with the non-arcuate concave teeth of the ratchet wheel in FIG. 8.

FIG. 13*b* is a top view of the pawl in FIG. 13*a*.

FIG. 13*c* is a side view of the pawl in FIG. 13*a*.

DETAILED DESCRIPTION OF THE PREFERRED EMBODIMENTS

Figure 1:
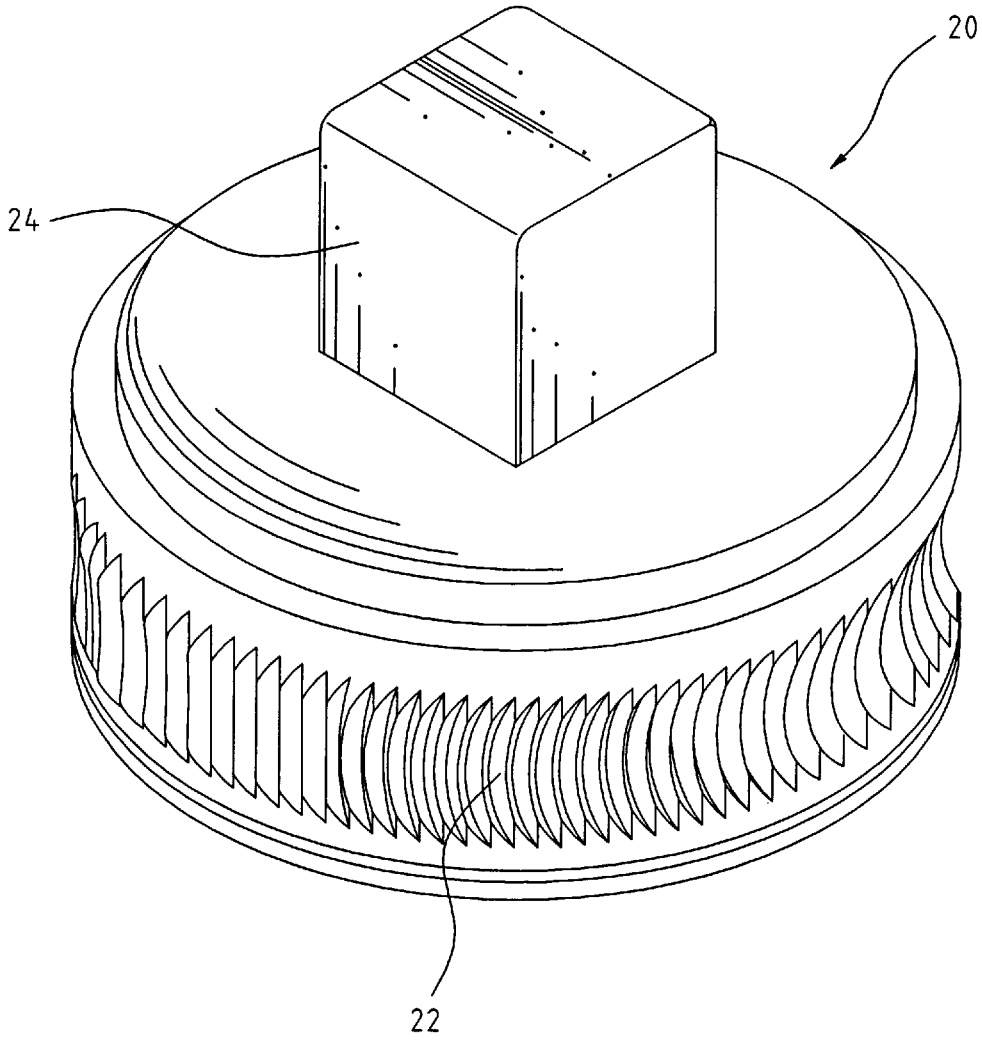
FIG. 1 is a perspective view of a ratchet wheel with asymmetric arcuate concave teeth in accordance with the present invention.
Figure 2:
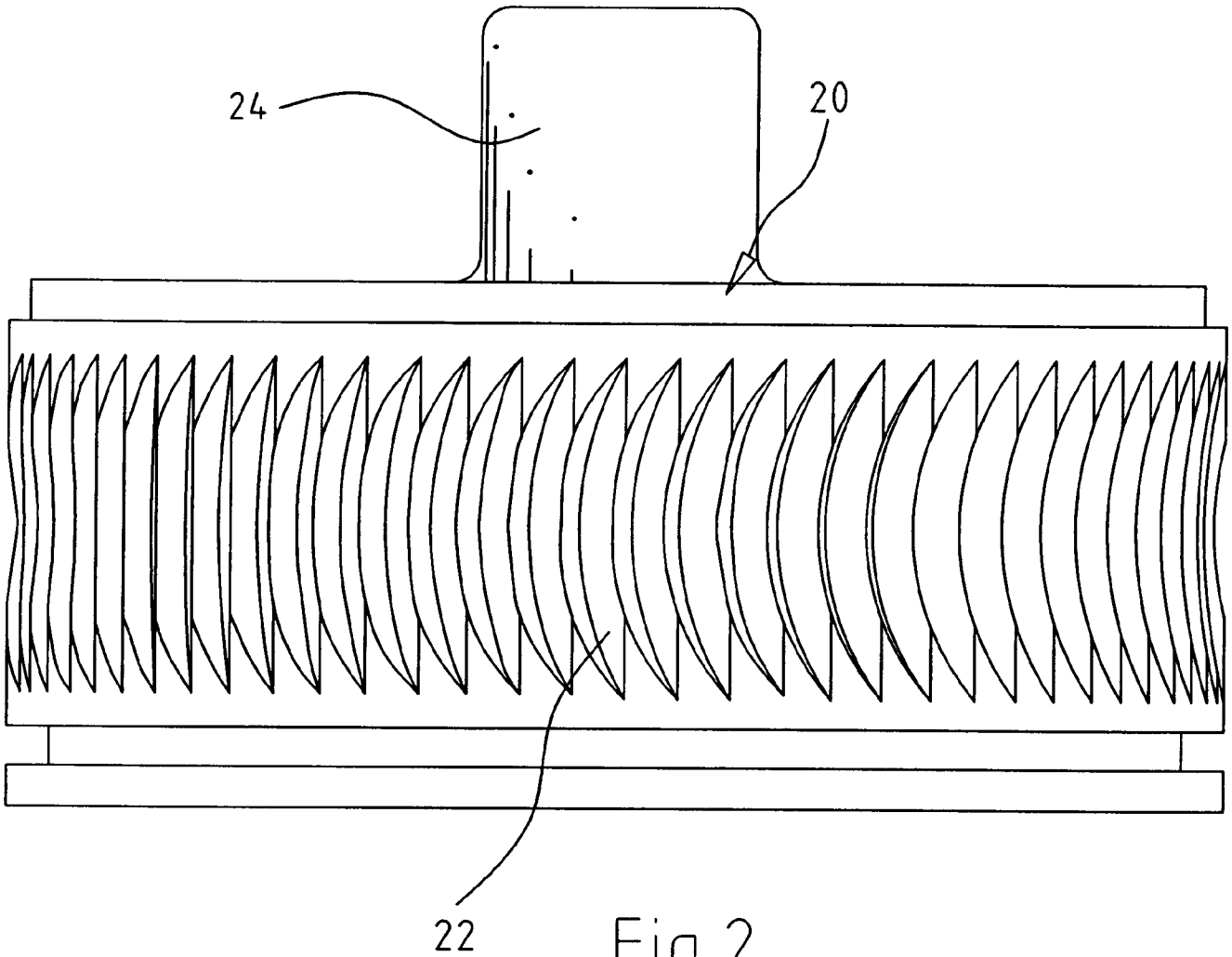
FIG. 2 is a side view of the ratchet wheel in accordance with the present invention.
Figure 3:
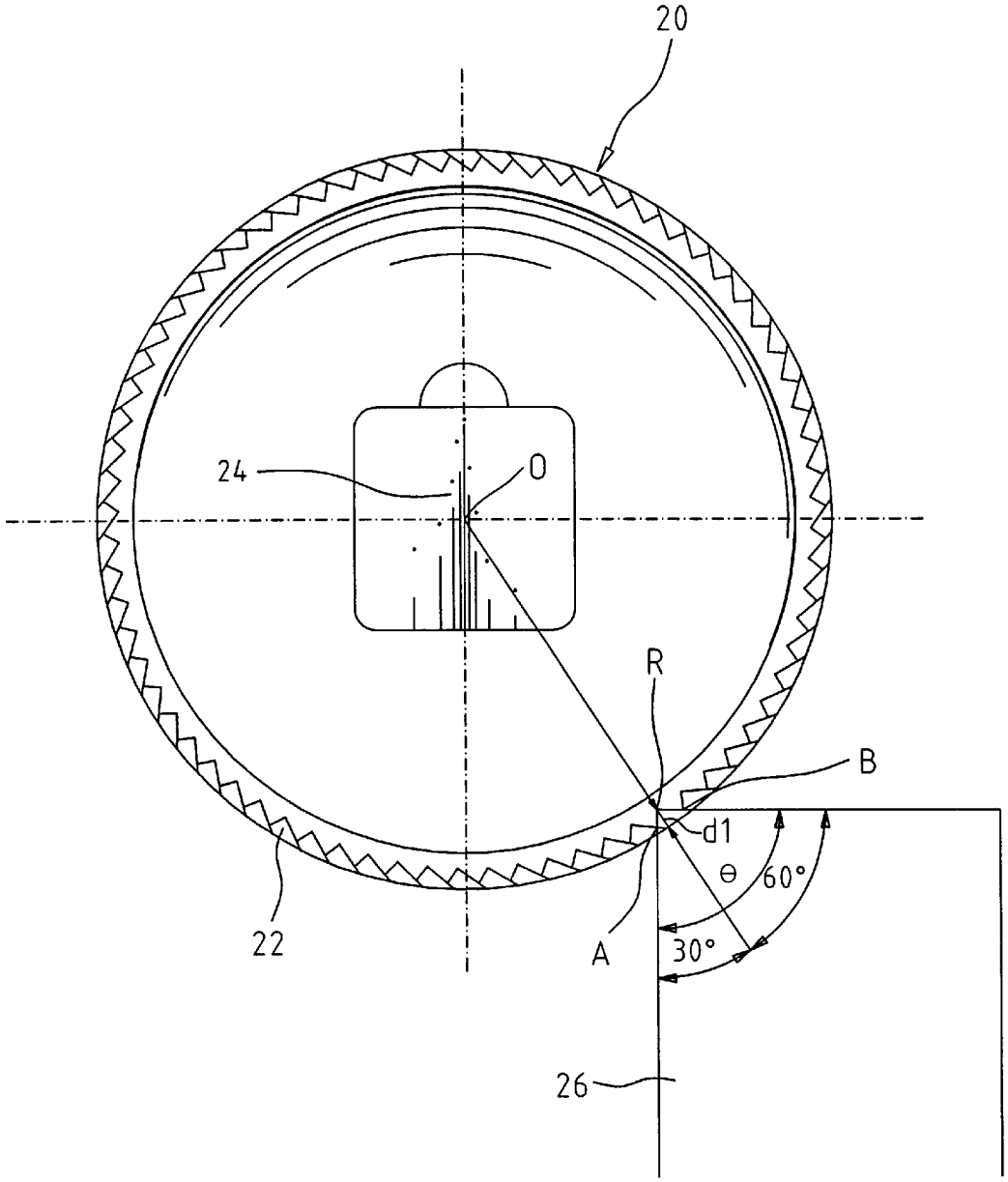
FIG. 3 is a top view of the ratchet wheel in accordance with the present invention, illustrating formation of asymmetric arcuate concave teeth in an outer periphery of the ratchet wheel.

Referring to FIGS. 1 through 5 and initially to FIGS. 1 through 3, a ratchet wheel 20 in accordance with the present invention generally includes a drive column 24 for engaging with a socket wrench (not shown) and an outer periphery having a plurality of arcuate concave teeth 22. Referring to FIG. 3, each arcuate concave tooth 22 is formed by means of feeding a cutter 26 along a direction transverse to a radial direction (see line OR). The resultant concave tooth 22 has a depth "$d_1$" and two sides RA and RB that intersect at point "R". The line OR divides the angle θ defined by the two sides RA and R13 of the concave tooth 22 into two unequal portions (e.g.; 30° and 60°, 40° and 50°, etc). Namely, every tooth 22 thus formed is "asymmetric" or the two sides for each teeth 22 is not equal, which is the most important feature of this embodiment of the present invention.

Figure 6:
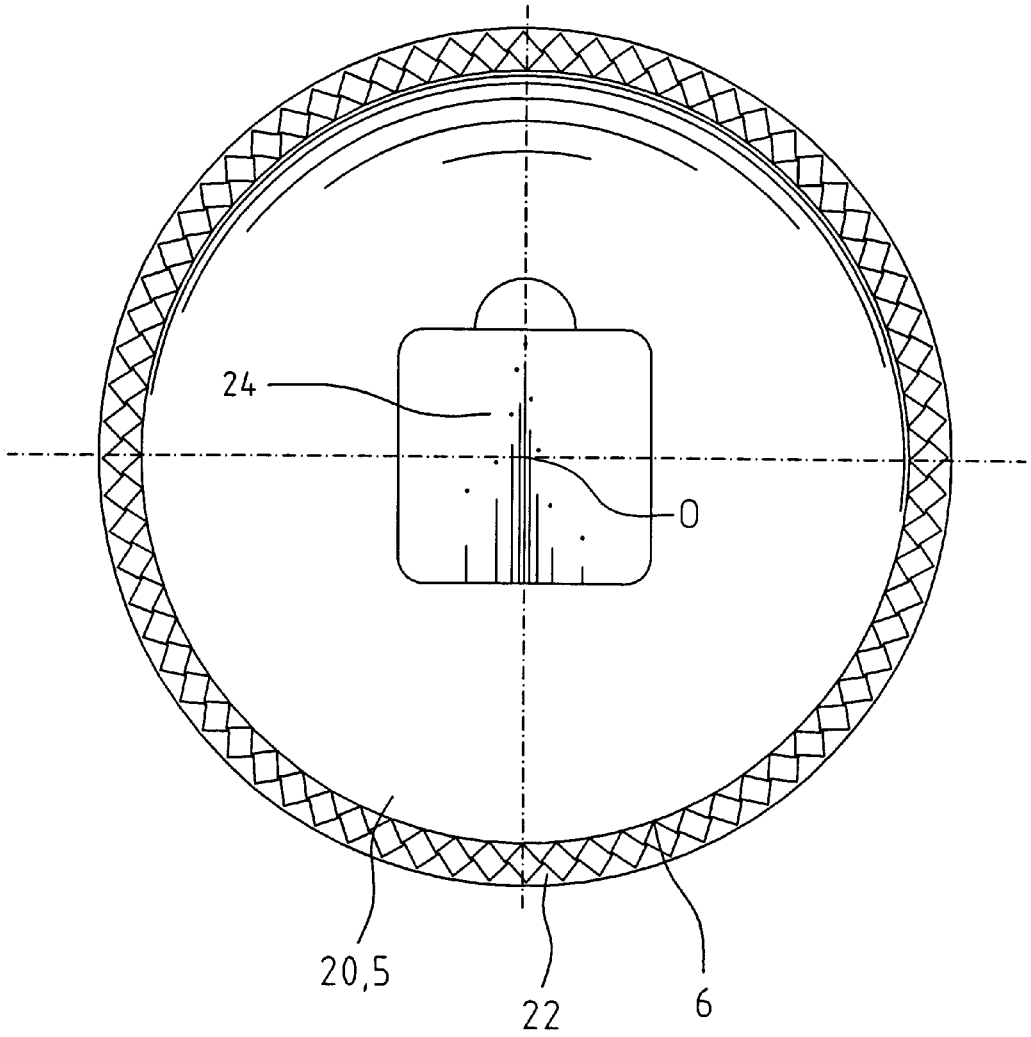
FIG. 6 is a top view, in an enlarged scale, of the ratchet wheel in accordance with the present invention, wherein position of symmetric concave teeth formed according to prior art is illustrated to show difference therebetween.

Difference in the depth of the tooth 22 of the ratchet wheel 20 of the present invention and the depth of the tooth 6 of a conventional ratchet wheel 5 is illustrated in FIG. 6. Namely, the ratchet wheel 20 of the present invention is machined to a shallower extent than the conventional ratchet wheel 5 that has the same size as the ratchet wheel 20. This allows quicker manufacture of the ratchet wheel 20 without adversely affecting the structural strength and the driving torque of the ratchet wheel of the present invention.

Figure 4:
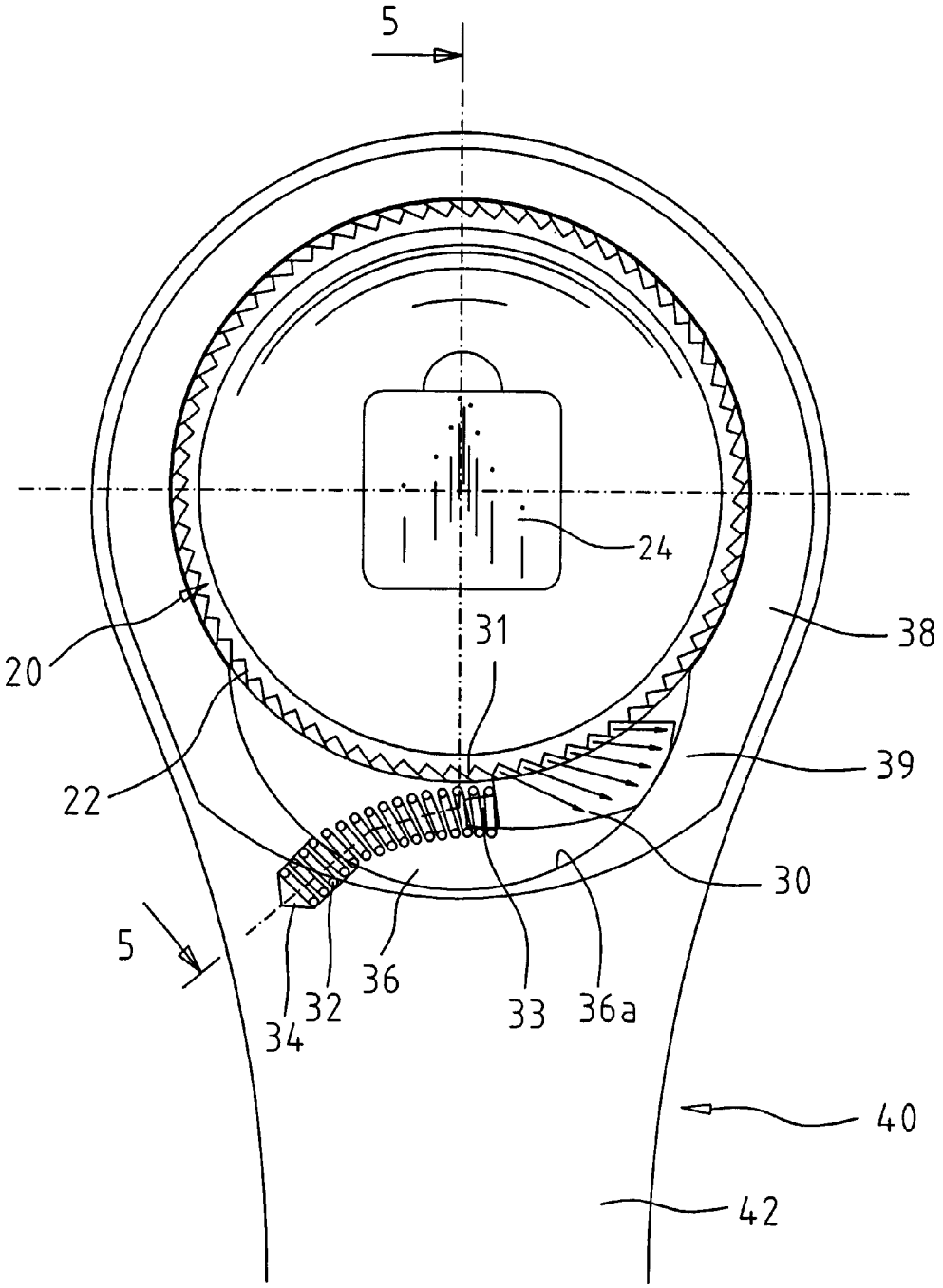
FIG. 4 is a top view of a head of a socket wrench equipped with the ratchet wheel in accordance with the present invention.
Figure 5:
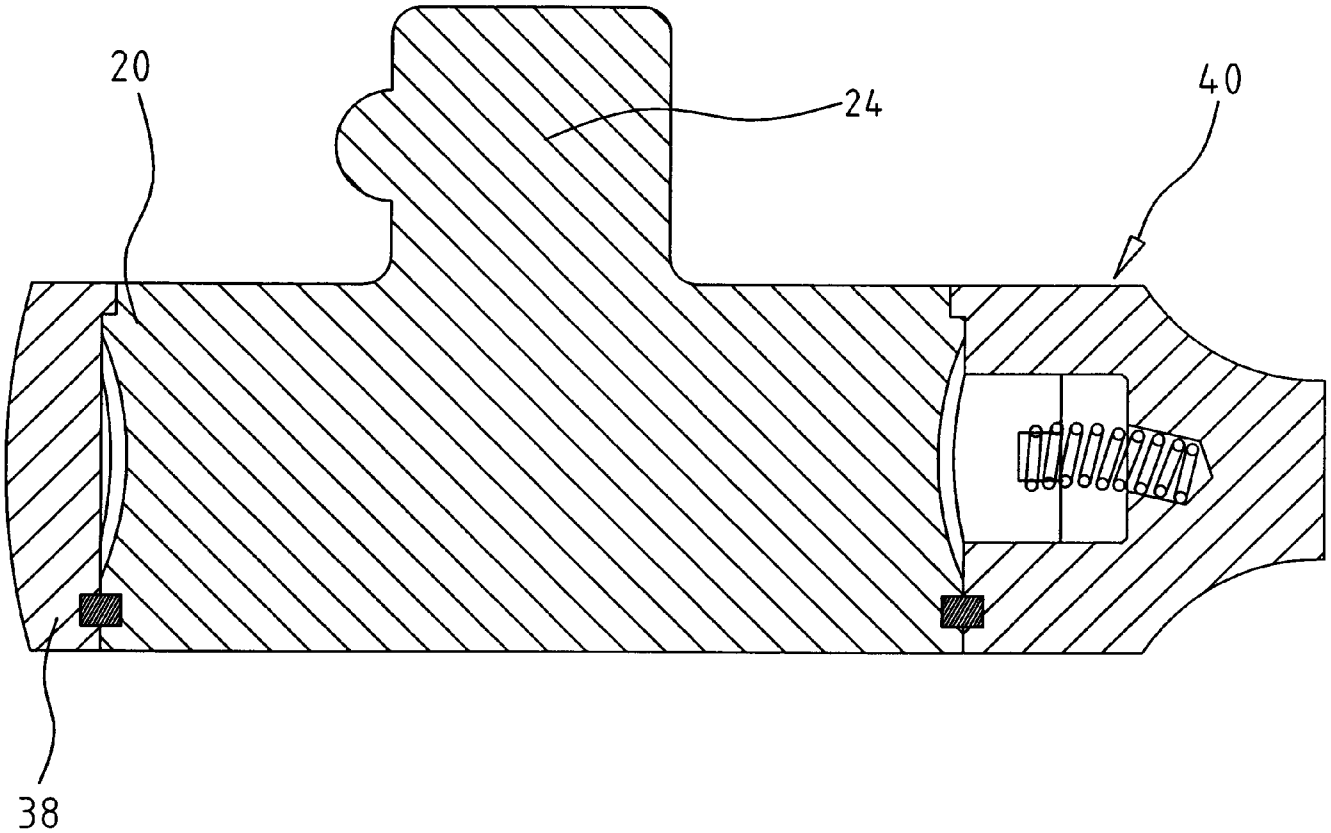
FIG. 5 is a sectional view taken along line 5—5 in FIG. 4.
Figure 7A:
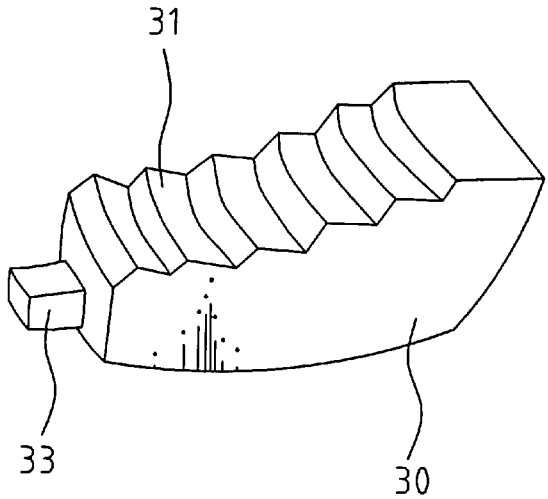
FIG. 7*a* is a perspective view of a pawl for cooperating with the asymmetric arcuate concave teeth of the ratchet wheel in accordance with the present invention.
Figure 7B:
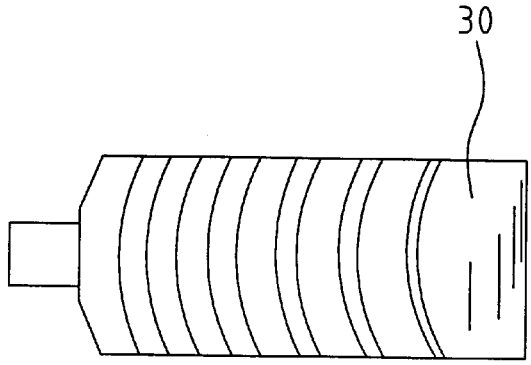
FIG. 7*b* is a top view of the pawl in FIG. 7*a*.
Figure 7C:
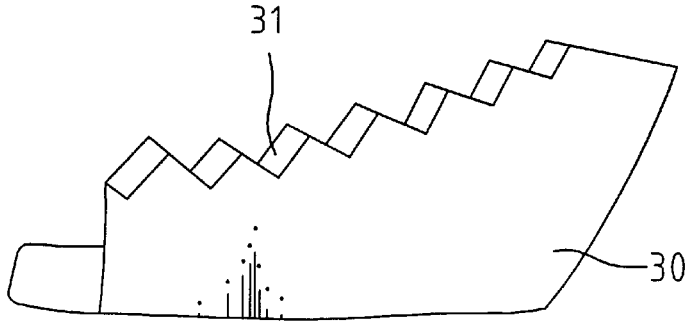
FIG. 7*c* is a side view of the pawl in FIG. 7*a*.

Referring to FIG. 4, the ratchet wheel 20 in accordance with the present invention is rotatably mounted in a head 38 of a socket wrench 40. A web area 39 between the head 38 and a handle 42 of the socket wrench 40 includes a compartment 36 for receiving a pawl 30. FIGS. 7*a* through 7*c* illustrate the pawl 30. The pawl 30 includes a plurality of teeth 31 that are formed complimentary to the curvatures of the asymmetric arcuate concave teeth 22. An end 33 of the pawl 30 is attached to an end of an elastic member 32 the other end of which is received in a cavity 34 defined in a wall 36*a* defining the compartment 36, best shown in FIG. 4.

Figure 8:
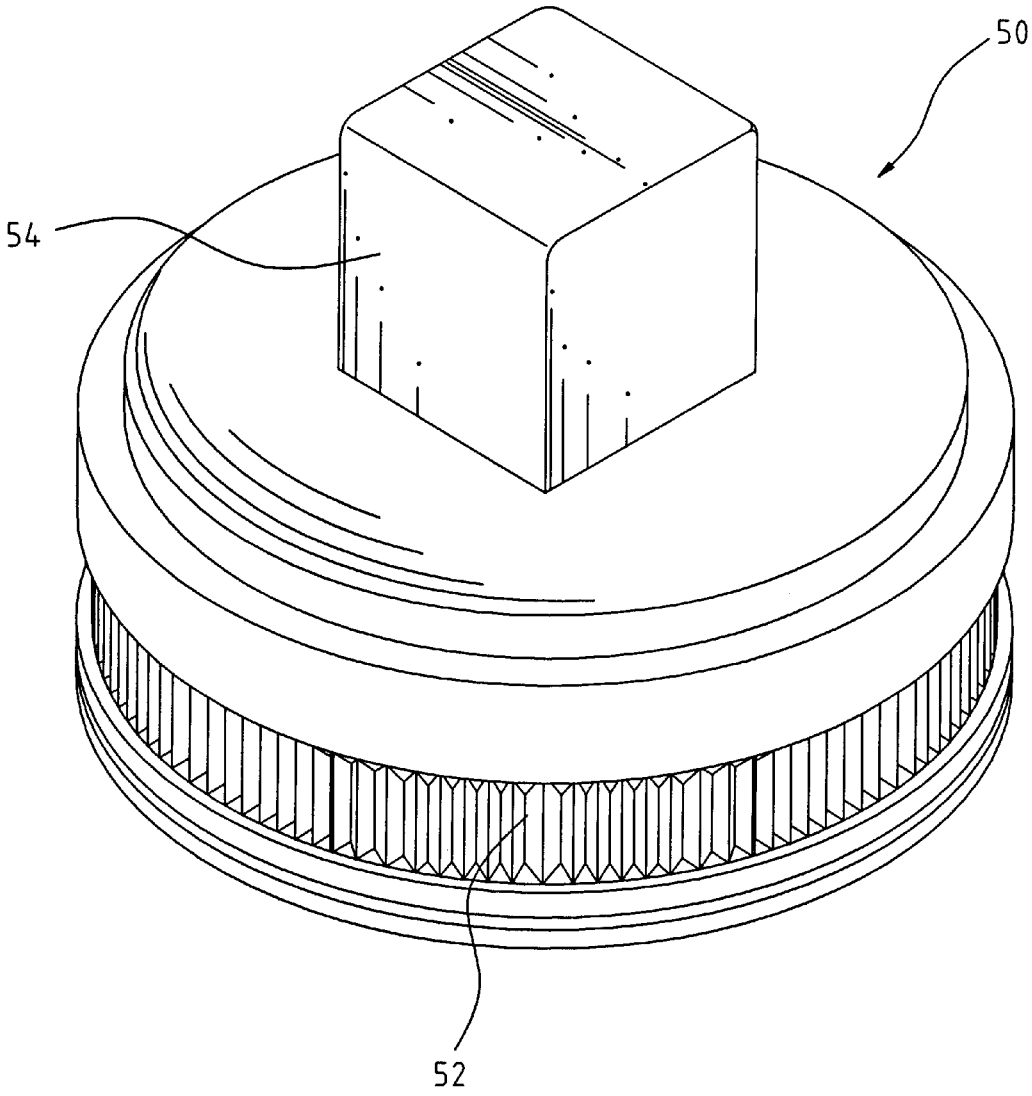
FIG. 8 is a perspective view of a ratchet wheel with non-arcuate concave teeth in accordance with the present invention.
Figure 9:
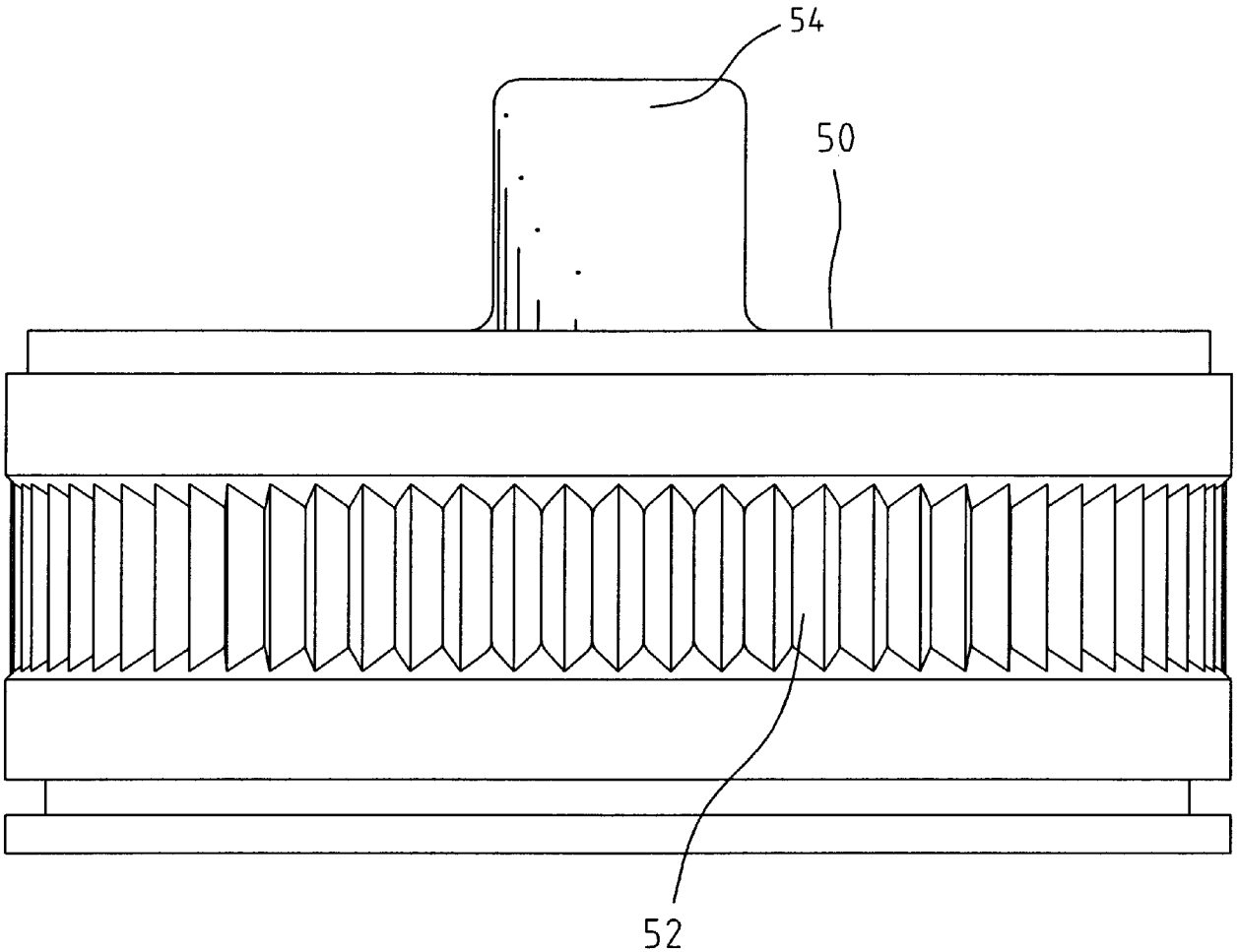
FIG. 9 is a side view of the ratchet wheel in FIG. 8.

Referring to FIGS. 8 and 9. in a second embodiment of the ratchet wheel in accordance with the present invention, the ratchet wheel (now designated by 50) includes a drive column 54 engaging with a socket wrench (not shown) and an outer periphery having a plurality of non-arcuate concave teeth 52. The non-arcuate concave teeth 52 is formed by means of roll squeezing method, investment casting, or molding, which is quicker than formation by cutter. Each non-arcuate concave tooth 52 may be trapezoidal, triangular, or any other shape that results from formation other than cutting. The production cost for the ratchet wheel 50 with non-arcuate concave teeth 52 in accordance with the present invention is largely reduced, as the production time for the non-arcuate concave teeth 52 is relatively short. In addition, the non-arcuate concave teeth 52 may be symmetric or asymmetric. When the ratchet wheel 50 has non-arcuate symmetric concave teeth 52, the resultant structure provides a driving torque approximately the same as that provided by the conventional ratchet wheel 5 with sym metric arcuate concave teeth 6. When the ratchet wheel 50 has non-arcuate asymmetric concave teeth 52 configured similar to teeth 22, the resultant structure provides a higher driving torque than that provided by the conventional ratchet wheel 5 with symmetric arcuate concave teeth 6.

Figure 10:
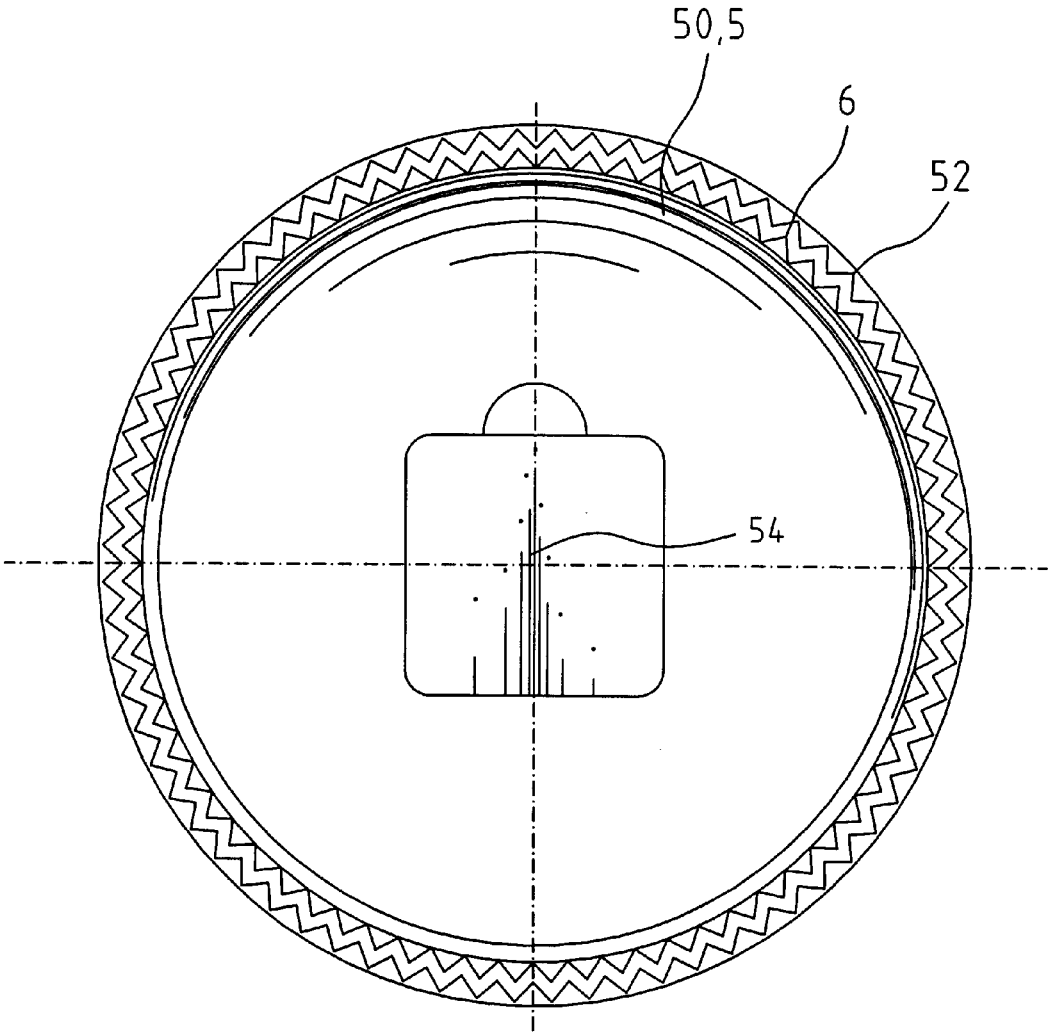
FIG. 10 is a top view of the ratchet wheel in FIG. 8, wherein position of symmetric concave teeth formed according to prior art is illustrated to show difference therebetween.

Difference in the depth of the tooth 52 of the ratchet wheel 50 of the present invention and the depth of the tooth 6 of a conventional ratchet wheel 5 is illustrated in FIG. 10. Namely, the ratchet wheel 50 of the present invention is machined to a shallower extent than the conventional ratchet wheel 5 that has the same size as the ratchet wheel 50.

Figure 11:
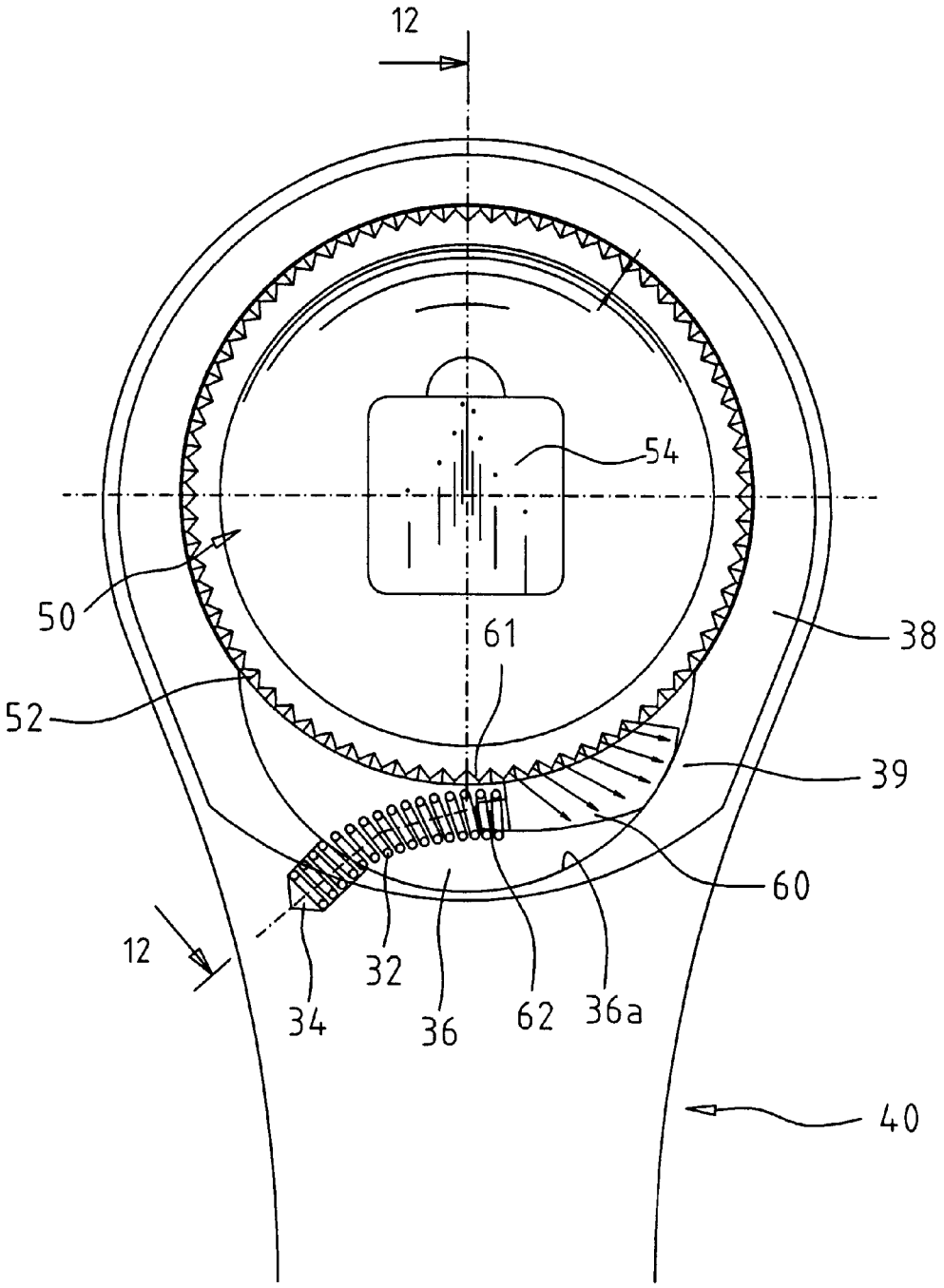
FIG. 11 is a top view of a head of a socket wrench equipped with the ratchet wheel in FIG. 8.
Figure 12:
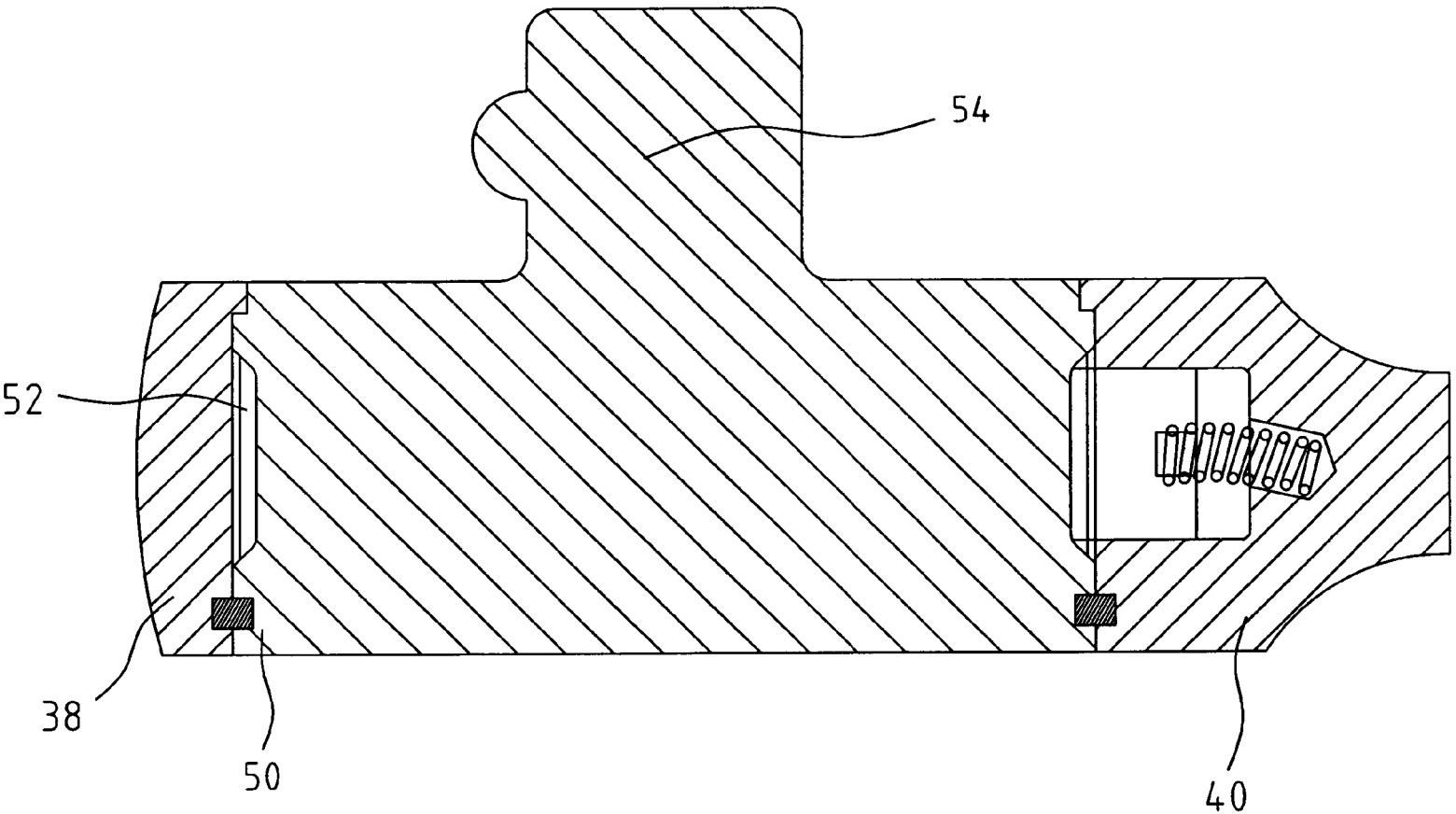
FIG. 12 is a sectional view taken along line 12—12 in FIG. 11.

Referring to FIGS. 11 and 12, the ratchet wheel 50 in accordance with the present invention may be rotatably mounted in a head 38 of a socket wrench 40. A web area 39 of the socket wrench 40 includes a compartment 36 for receiving a pawl 60. FIGS. 13*a* through 13*c* illustrate the pawl 60. The pawl 60 includes a plurality of teeth 61 that are formed complimentary to the curvatures of the non-arcuate concave teeth 52. An end 62 of the pawl 60 is attached to an end of an elastic member 32 the other end of which is received in a cavity 34 defined in a wall 36*a* defining the compartment 36, best shown in FIG. 11.

Although the invention has been explained in relation to its preferred embodiment, it is to be understood that many other possible modifications and variations can be made without departing from the spirit and scope of the invention as hereinafter claimed.

What is claimed is:

1. A ratchet wheel comprising an outer periphery, the outer periphery including a plurality of asymmetric arcuate concave teeth each having two sides and an intersection of the two sides, the ratchet wheel including a center, a line from the center to the intersection dividing an angle between the two sides into two unequal portions.

2. A ratchet wheel comprising an outer periphery, the outer periphery including a plurality of asymmetric non-arcuate concave teeth each having two sides and an intersection of the two sides, the ratchet wheel including a center, a line from the center to the intersection dividing an angle between the two sides into two unequal portions.

3. The ratchet wheel as claimed in claim 2, wherein said asymmetric non-arcuate concave teeth are not formed by cutting.

4. The ratchet wheel as claimed in claim 2, wherein said asymmetric non-arcuate concave teeth are formed by roll squeezing.

5. The ratchet wheel as claimed in claim 2, wherein said asymmetric non-arcuate concave teeth are formed by investment casting.

6. The ratchet wheel as claimed in claim 2, wherein each said asymmetric non-arcuate concave tooth is trapezoidal.

7. The ratchet wheel as claimed in claim 2, wherein each said asymmetric non-arcuate concave tooth is of a shape formed as a result of formation other than cutting.

8. A ratchet wheel comprising an outer periphery, the outer periphery including a plurality of symmetric non-arcuate concave teeth each having two sides and an intersection of the two sides, the ratchet wheel including a center, a line from the center to the intersection dividing an angle between the two sides into two equal portions.

9. The ratchet wheel as claimed in claim 8, wherein said symmetric non-arcuate concave teeth are not formed by cutting.

10. The ratchet wheel as claimed in claim 8, wherein said symmetric non-arcuate concave teeth are formed by roll squeezing.

11. The ratchet wheel as claimed in claim 8, wherein said symmetric non-arcuate concave teeth are formed by investment casting.

12. The ratchet wheel as claimed in claim 8, wherein each said symmetric non-arcuate concave tooth is trapezoidal.

13. The ratchet wheel as claimed in claim 8, wherein each said symmetric non-arcuate concave tooth is of a shape formed as a result of formation other than cutting.

14. A socket wrench comprising:

a handle and a head connected to the handle, a compartment being defined in an area between the handle and the head;

a ratchet wheel rotatably mounted in the head, the ratchet wheel comprising an outer periphery, the outer periphery including a plurality of asymmetric arcuate concave teeth each having two sides and an intersection of the two sides, the ratchet wheel including a center, a line from the center to the intersection dividing an angle between the two sides into two unequal portions;

a pawl slidably mounted in the compartment and engaged with the ratchet wheel, the pawl comprising a plurality of teeth corresponding to the asymmetric arcuate concave teeth of the ratchet wheel; and means for biasing the pawl toward a wall defining the compartment.

15. A socket wrench comprising:

a handle and a head connected to the handle, a compartment being defined in an area between the handle and the head;

a ratchet wheel mounted in the head, the ratchet wheel comprising an outer periphery, the outer periphery including a plurality of asymmetric non-arcuate concave teeth each having two sides and an intersection of the two sides, the ratchet wheel including a center, a line from the center to the intersection dividing an angle between the two sides into two unequal portions;

a pawl slidably mounted in the compartment and engaged with the ratchet wheel, the pawl comprising a plurality of teeth corresponding to the asymmetric non-arcuate concave teeth of the ratchet wheel; and means for biasing the pawl toward a wall defining the compartment.

16. The socket wrench as claimed in claim 15, wherein said asymmetric non-arcuate concave teeth are formed by roll squeezing.

17. The socket wrench as claimed in claim 15, wherein each said asymmetric non-arcuate concave tooth is of a shape formed as a result of formation other than cutting.

18. A socket wrench comprising:

a handle and a head connected to the handle, a compartment being defined in an area between the handle and the head;

a ratchet wheel mounted in the head, the ratchet wheel comprising an outer periphery, the outer periphery including a plurality of symmetric non-arcuate concave teeth each having two sides and an intersection of the two sides, the ratchet wheel including a center, a line from the center to the intersection dividing an angle between the two sides into two equal portions;

a pawl slidably mounted in the compartment and engaged with the ratchet wheel, the pawl comprising a plurality of teeth corresponding to the symmetric non-arcuate concave teeth of the ratchet wheel; and means for biasing the pawl toward a wall defining the compartment.

19. The socket wrench as claimed in claim 18, wherein said symmetric non-arcuate concave teeth are formed by roll squeezing.

20. The socket wrench as claimed in claim 18, wherein each said symmetric non-arcuate concave tooth is of a shape formed as a result of formation other than cutting.

* * * * *